US005922275A

United States Patent [19]

Kageyama et al.

[11] Patent Number: 5,922,275

[45] Date of Patent: Jul. 13, 1999

[54] ALUMINUM-CHROMIUM ALLOY, METHOD FOR ITS PRODUCTION AND ITS APPLICATIONS

[75] Inventors: Toshiyuki Kageyama; Yasuo Imamura; Kei Isozaki, all of Omuta, Japan

[73] Assignee: Denki Kagaku Kogyo Kabushiki Kaisha, Tokyo, Japan

[21] Appl. No.: 08/851,531

[22] Filed: May 5, 1997

[30] Foreign Application Priority Data

May 8, 1996 [JP] Japan ..... 8-113704

[51] Int. Cl.[6] ..... C22C 27/06; C22C 21/00

[52] U.S. Cl. ..... 420/428; 420/528; 420/552

[58] Field of Search ..... 420/428, 528, 420/552

[56] References Cited

U.S. PATENT DOCUMENTS

| | | | |
|---|---|---|---|
| 3,800,631 | 4/1974 | Baxter | 75/124 |
| 4,645,644 | 2/1987 | Orlowski | 420/587 |
| 5,006,308 | 4/1991 | Liu et al. | 420/445 |

FOREIGN PATENT DOCUMENTS

| | | |
|---|---|---|
| 2 239 134 | 6/1973 | Germany . |
| 2 282 640 | 4/1995 | United Kingdom . |

OTHER PUBLICATIONS

Thaddeus B. Massalski, American Society for Metals, vol. 1, three pages and p. 104, 1986, "Binary Alloy Phase Diagrams".

Derwent Abstracts, AN 95–041683, Japan Abstracts, AN 05105288, and JP 06 322 507, Nov. 22, 1994.

Derwent Abstracts, AN 94–290281, Japan Abstracts, AN 04010279, and JP 06 218 489, Aug. 9, 1994.

Derwent Abstracts, AN 94–031005, Japan Abstracts, AN 04142890, and JP 05 337 310, Dec. 21, 1993.

*Primary Examiner*—Jay H. Woo
*Assistant Examiner*—Betsey J. Morrison
*Attorney, Agent, or Firm*—Oblon, Spivak, McClelland, Maier & Neustadt, P.C.

[57] ABSTRACT

An aluminum-chromium alloy having an atomic ratio of aluminum to chromium of from 0.2 to 10.9 and a resistivity at room temperature of at most 1 Ω·cm after heat treatment in air at a temperature of 900° C. for 200 hours.

8 Claims, No Drawings

ALUMINUM-CHROMIUM ALLOY, METHOD FOR ITS PRODUCTION AND ITS APPLICATIONS

The present invention relates to an aluminum-chromium alloy suitable for forming an electrode, a circuit or the like, a method for its production, and as its applications, an electrode, a composite material, particularly a ceramic heater, and a diesel particulate filter.

An electric heater or the like is usually designed so that power source terminals are connected to both terminals of its heating element so that the heating element is heated by conducting electric current. Accordingly, for a ceramic heater, it becomes necessary to form on the ceramic material electrodes for connecting to the power source terminals. Heretofore, for electrodes for a ceramic heater made of silicon carbide or molybdenum disilicide, a conductive material such as aluminum, nickel, copper or an alloy thereof, has been used. However, such a conductive material has a problem that it is readily oxidized under a high temperature oxidizing atmosphere. For example, if electrodes are formed by such a conductive material on ceramics, and an electric current is conducted to ceramics while pressing power source terminals to the formed electrodes, the electrode surface will be oxidized, and the contact resistance will increase, thus leading to a problem such as local heat generation or impairment of electrical conduction. Therefore, it has been necessary to separate the electrode portions from the heat generating portion by means of a heat insulating material and to cool them so that the temperature of the electrode portions will be at most 400° C. during their use, and there has been a substantial restriction to the manner in which the heater is used.

As one type of applications of a composite material having electrodes formed on ceramics, an electrically heating type diesel particulate filter (hereinafter referred to as "DPF") may be mentioned. With DPF, if combustible fine particles contained in an exhaust gas of a diesel engine are collected by the porous wall of DPF, the pressure loss will increase, and the collecting efficiency will decrease. Therefore, it is necessary to regenerate DPF by removing the collected and deposited combustible fine particles periodically. For such regeneration, DPF itself is used as a heater and electrically heated to burn off the combustible fine particles.

DPF is placed in its entirety including the portions at which electrodes are formed, in a heat insulating tube, and it is exposed-to a high temperature exhaust gas during collecting of the combustible fine particles. Besides, the internal temperature of DPF will be as high as at least 900° C. due to combustion of the combustible fine particles during regeneration. Accordingly, the electrodes to be formed on DPF are required to have sufficient durability in an oxidizing atmosphere of at least 900° C. Further, it is subjected to heat history due to repeated operations of collecting and regeneration, and the electrodes are required to have excellent thermal shock resistance. As heat resistant materials having electrical conductivity, a heat resistant steel represented by SUS-310, a nickel-base heat resistant alloy, a cobalt-base heat resistant alloy, a M-Cr-Al alloy (M=Fe, Ni) (JP-A-54-74811) and a M-Cr-Al-Y alloy (M=Fe, Ni, Co, Ni-Co) (JP-A-61-106763) have heretofore been known. From the viewpoint of structural materials, it has been common with these materials to form an oxide layer on their surface and use it as a protecting film to prevent progress of oxidation and thereby to prevent peeling of scales or deterioration of the high temperature strength. However, these materials will be oxidized at a temperature of from 600 to 800° C., whereby their surface portions will be electrically insulated and can not be used as electrodes for DPF.

Whereas, a TiAl intermetallic compound has a small specific gravity and is excellent in the high temperature strength and oxidation resistance, and it has attracted an attention as a heat resistant material. However, its practically useful temperature is at most 700° C. Therefore, it has been proposed to improve the oxidation resistance by forming a $TiAl_3$ coating layer on the TiAl surface (JP-A-1-111858). Also in this case, oxidation of the surface layer is not negligible at a temperature of 800° C. or higher, and it can hardly be regarded as having adequate oxidation resistance. Further, TiAl or $TiAl_3$ is brittle as compared with a usual metal or alloy and is poor in ductility. Therefore, in complexing with ceramics, it also has a problem from the viewpoint of the thermal shock resistance. Further, such a material is rather difficult to process, and titanium is very active. Therefore, as its forming method, it has been common to employ a method of thermal spraying under reduced pressure or in a non-oxidizing atmosphere. This method has a merit in that an intermetallic compound having little pores can be constantly formed. On the other hand, it has a demerit that the costs tend to be high as the number of steps increases, for example, due to the pressure-reducing operation or due to the necessity of an installation such as a chamber.

In the case of silver or gold, there is no practical problem at a temperature of about 900° C., but the heat resistance tends to be inadequate at a high temperature of 1,000° C. or higher. Platinum or a platinum alloy which has ductility and which-is most reliable from the viewpoint of oxidation resistance, is extremely expensive, and it is problematic from the viewpoint of costs to use such an expensive material in a large amount on an industrial scale.

Under the above-described circumstances, it is an object of the present invention to provide a heat resistant conductive material, particularly an electrode, having excellent electrical conductivity, whereby the surface oxidation will not proceed even in a high temperature oxidizing atmosphere, particularly in an environment having a temperature of from 900 to 1,000° C.

Another object of the present invention is to provide a composite material, particularly a heater or DPF, which is free from cracking or peeling from ceramics even when subjected to repeated heat history.

Such objects of the present invention can be accomplished by producing an aluminum-chromium alloy by thermally spraying a blend powder or alloy powder comprising aluminum and chromium in an atomic ratio of aluminum to chromium of from 0.2 to 10.9.

That is, the present invention provides:

1. An aluminum-chromium alloy having an atomic ratio of aluminum to chromium of from 0.2 to 10.9 and a resistivity at room temperature of at most 1Ω·cm after heat treatment in air at a temperature of 900° C. for 200 hours.
2. The aluminum-chromium alloy according to Item 1, which further contains at most 50 wt % (excluding 0 wt %) of at least one component selected from lanthanum hexaboride, titanium, manganese and nickel.
3. A method for producing an aluminum-chromium alloy, which comprises thermally spraying a blend powder or alloy powder comprising aluminum and chromium in an atomic ratio of aluminum to chromium of from 0.2 to 10.9, or such a blend powder or alloy powder which further contains at most 50 wt % (excluding 0 wt %) of at least one component selected from lanthanum hexaboride, titanium, manganese and nickel.

4. An electrode made of an aluminum-chromium alloy as defined in Item 1 or 2.
5. A composite material comprising an aluminum-chromium alloy as defined in Item 1 or 2 and ceramics, which are integrated to each other.
6. A ceramic heater made of a composite material as defined in Item 5.
7. A diesel particulate filter provided with a ceramic heater as defined in Item 6.

Now, the present invention will be described in further detail with reference to the preferred embodiments.

The aluminum-chromium alloy (hereinafter referred to as the "Al-Cr alloy") of the present invention has an atomic ratio of aluminum to chromium of from 0.2 to 10.9, preferably from 0.6 to 6.8. If this atomic ratio exceeds 10.9, the alloy tends to melt and no longer be useful as an electrode, when exposed to a high temperature oxidizing atmosphere. On the other hand, if it is less than 0.2, the surface oxidation tends to proceed, whereby the electrical conductivity tends to be low. The Al-Cr alloy having the atomic ratio of the present invention will not be melted or spheroidized even at a temperature of at least 660° C. as the melting point of aluminum.

Now, the second condition which the Al-Cr alloy of the present invention must satisfy is that the resistivity at room temperature is smaller than ceramics even after subjected to heat history at a high temperature. Namely, the Al-Cr alloy of the present invention is required to have a resistivity at room temperature of at most 1 Ω·cm when returned to room temperature after heat treatment in air at a temperature of 900° C. for 200 hours. Here, the resistivity at room temperature includes the contact resistance due to the surface oxidation.

To the Al-Cr alloy of the present invention, a third component may be incorporated so long as the above-mentioned characteristic of the resistivity at room temperature is not impaired. The third component may be at least one member selected from lanthanum hexaboride, titanium, manganese and nickel. The electrical conductivity will be further improved by the incorporation of such a-third component. The total of the contents of such third components is at most 50 wt % (excluding 0 wt %). It is particularly preferred that the content of lanthanum hexaboride is at most 46 wt %, especially at most 36 wt %, the content of titanium is at most 15 wt %, and the content of manganese or nickel is at most 30 wt %. The third component particularly suitable for the present invention is lanthanum hexaboride. To the Al-Cr alloy of the present invention, oxygen may further be incorporated in an amount of not more than 10 wt %. In this case, oxygen is present mainly as chromium oxide.

Now, a method for producing the Al-Cr alloy of the present invention will be described.

The Al-Cr alloy of the present invention can be produced by a method which comprises vapor-depositing on a substrate aluminum and chromium in an atomic ratio of aluminum to chromium of from 0.2 to 10.9, preferably from 0.6 to 6.8, by PVD or CVD, or a method which comprises thermally spraying a blend powder of aluminum and chromium or an alloy powder produced by heating and melting such a blend powder. The thermal spraying method is simple and preferred, since the melting points of aluminum and chromium are 660° C. and 2,163° C., respectively, and thus extremely different, and accordingly a due care is required for their handling. The Al-Cr alloy containing the above-mentioned third component, can be prepared by thermally spraying the above-mentioned blend powder or alloy powder of aluminum and chromium, which further contains the third component.

Now, the thermal spraying method to be employed in the present invention will be described. For the thermal spraying method, plasma spraying, arc spraying or flame spraying may, for example, be used. From the viewpoint of the running cost and freeness in the choice of starting materials, plasma spraying is preferred. There is no particular restriction as to the conditions of the atmosphere for carrying out the spraying, but the atmospheric air under atmospheric pressure is preferred from the viewpoint of the productivity and costs, since no special chamber for the atmosphere is thereby required. By the thermal spraying in the atmospheric air under atmospheric pressure, no substantial formation of aluminum oxide is observed, although slight formation of chromic oxide is observed, and a good Al-Cr alloy can be produced with no substantial deterioration in the electrical conductivity. In this case, an Al-Cr intermetallic compound can be formed by adjusting the temperature of the substrate to be sprayed, to a level of at least 500° C.

The spray material is selected depending upon the desired properties of the alloy so that the atomic ratio of aluminum to chromium will be within a range of from 0.2 to 10.9. Here, the spray material may be a blend powder containing aluminum and chromium or may be a powder of an alloy preliminarily produced by heating and melting such a blend powder. Further, in a case where the above-mentioned third component is incorporated, such a third component may be mixed to the above-mentioned blend powder or alloy powder of aluminum and chromium, or may be a powder of such a third component coated with an alloy of aluminum and chromium.

As an application of the Al-Cr alloy of the present invention, the alloy itself can be used as an electrode, or it may be integrated with ceramics to obtain a composite material, which may then be used as a circuit board, a ceramic heater or DPF.

Now, the composite material of the present invention will be described.

For the composite material of the present invention, various shapes or ceramics may be selected depending upon the particular purpose or application. The ceramics constituting the composite material of the present invention are preferably those having heat resistance. For example, oxide type ceramics such as alumina or zirconia, or non-oxide type ceramics such as silicon carbide, silicon nitride or molybdenum disilicide may be used. Among them, silicon carbide or molybdenum disilicide is excellent in both the electrical properties and the heat resistance, and is useful for a ceramic heater.

To integrate the ceramics and the Al-Cr alloy, the above-mentioned thermal spraying method is preferred. The shape, size and forming position of the Al-Cr alloy can freely be selected depending upon the particular purpose or application. When the composite material of the present invention is to be used for DPF, the ceramics preferably have a honeycomb structure of a porous wall made mainly of silicon carbide or molybdenum disilicide having high electrical conductivity and high heat resistance, and the thickness of the Al-Cr alloy is preferably from 10 to 300 μm. If the thickness is less Athan 10 μm, the effects for the heat resistance and electrical conductivity tend to be inadequate, thus leading to a problem such as an increase of the resistance or local heat generation when electric current is applied. On the other hand, if the thickness exceeds 300 μm, the thermal stress formed by heat cycle of heating and cooling can not adequately be moderated, and peeling from the ceramics or cracking of the ceramics tends to result.

DPF will further be described. The shape of the honeycomb structure is, for example, such that the length in the axial direction is from 20 to 500 mm, the thickness of the porous wall is from 0.1 to 1.0 mm, the through-hole cell pitch is from 1.14 to 3.59 mm, through-hole cell density is from 50 to 500 cells per square inch.

Now, the present invention will be described in further detail with reference to Examples and Comparative Examples. However, it should be understood that the present invention is by no means restricted to such specific Examples.

EXAMPLES 1 TO 17 AND COMPARATIVE EXAMPLES 1 TO 4

A blend powder comprising commercially available aluminum powder (purity: at least 99%, particle size: at most 125 μm) and chromium powder (purity: at least 98%, particle size: at most 75 μm) was plasma-sprayed in the atmospheric air on a honeycomb structure made of silicon carbide (SiC) or molybdenum disilicide ($MoSi_2$) having an end face size of 100×100 mm, a length in the axial direction of 100 mm, a wall thickness of 0.43 mm, a through-hole cell pitch of 2.54 mm and a through-hole cell density of 100 cells/inch$^2$, to form various types of an Al-Cr alloy film. The Al-Cr alloy film was formed on the end face and the entire surface of the outer circumference with a width of 10 mm from the end face of the honeycomb structure. An example of the spray conditions was such that the plasma electric power was 35 kw, the plasma gas was Ar-$H_2$, the material-supply rate was 40 g/min, and the spray distance was 150 mm.

With respect to each Al-Cr alloy film, the Al/Cr atomic ratio, the oxygen content, and the alloy film thickness, were measured by means of fluorescent X-ray analyzer ("RIX-3000", manufactured by Rigaku Denki Kogyo K.K.), an O/N analyzer t"EMGA-2800", manufactured by Horiba Seisakusho K.K.) and a micrometer, respectively. The results are shown in Table 1.

TABLE 1

| | Honeycomb structure | | Al—Cr alloy film | | |
|---|---|---|---|---|---|
| | Main component | Resistivity (Ω · cm) | Al/Cr atomic ratio | Oxygen content (wt %) | Film thickness (μm) |
| Example 1 | SiC | 2.8 | 0.2 | 6.5 | 50 |
| Example 2 | SiC | 2.8 | 0.5 | 6.2 | 50 |
| Example 3 | SiC | 2.8 | 0.6 | 6.2 | 50 |
| Example 4 | SiC | 2.8 | 1.9 | 5.4 | 50 |
| Example 5 | SiC | 2.8 | 4.5 | 5.5 | 50 |
| Example 6 | SiC | 2.8 | 6.8 | 5.2 | 50 |
| Example 7 | SiC | 2.8 | 7.7 | 4.9 | 50 |
| Example 8 | SiC | 2.8 | 10.9 | 4.7 | 50 |
| Example 9 | SiC | 2.8 | 0.5 | 10.1 | 50 |
| Example 10 | SiC | 2.8 | 2.4 | 9.5 | 50 |
| Example 11 | $MoSi_2$ | 1.3 | 0.5 | 6.0 | 50 |
| Example 12 | $MoSi_2$ | 1.3 | 1.9 | 5.5 | 50 |
| Example 13 | SiC | 2.8 | 2.0 | 5.8 | 10 |
| Example 14 | SiC | 2.8 | 1.9 | 5.4 | 100 |
| Example 15 | SiC | 2.8 | 1.9 | 5.3 | 300 |
| Example 16 | SiC | 2.8 | 2.0 | 5.7 | 7 |
| Example 17 | SiC | 2.8 | 1.9 | 5.4 | 350 |
| Comparative Example 1 | SiC | 2.8 | 0 | 9.1 | 50 |
| Comparative Example 2 | SiC | 2.8 | 0.1 | 6.8 | 50 |
| Comparative Example 3 | SiC | 2.8 | 14.1 | 4.7 | 50 |
| Comparative Example 4 | SiC | 2.8 | 30.2 | 4.6 | 50 |

Then, each honeycomb structure was cut along a position of 20 mm in width from the end face thereof to obtain a test specimen, which was subjected to the following thermal shock resistance test. Further, on an optional face of the honeycomb structure, an Al-Cr alloy film of 10 mm in width×100 mm in length, was separately formed, and the following oxidation resistance test was carried out.

(1) Oxidation Resistance

Heat treatment was carried out in air at 900° C. for 200 hours and at 1,000° C. for 200 hours, and the resistivity at room temperature before and after the heat treatment was measured. The resistivity was measured between contact points provided at a distance of 80 mm on the Al-Cr alloy film, and the measured value includes the contact resistance due to the surface oxidation.

(2) Thermal Shock Resistance

The test specimen was introduced into a furnace of 900° C. immediately from room temperature in air and maintained for 10 minutes, whereupon it was immediately left to cool at room temperature for 10 minutes. This operation was taken as one cycle, and while observing the appearance of the test specimen, the test was carried out up to 200 cycles, whereby the number of cycles at which peeling or cracking was observed in the test specimen was measured.

TABLE 2

| | Oxidation resistance: resistivity at room temperature of Al—Cr alloy film (2Ω · cm) | | | Thermal shock resistance: number of |
|---|---|---|---|---|
| | Before heat treatment | After heat treatment at 900° C. | After heat treatment at 1,000° C. | cycles at which peeling or cracking occurred |
| Example 1 | $8.9 \times 10^{-4}$ | $1.7 \times 10^{-2}$ | >1 | >200 |
| Example 2 | $3.8 \times 10^{-4}$ | $8.3 \times 10^{-3}$ | >1 | >200 |
| Example 3 | $2.3 \times 10^{-4}$ | $1.4 \times 10^{-2}$ | $4.8 \times 10^{-2}$ | >200 |
| Example 4 | $1.5 \times 10^{-4}$ | $2.5 \times 10^{-2}$ | $3.4 \times 10^{-2}$ | >200 |
| Example 5 | $1.9 \times 10^{-4}$ | $4.5 \times 10^{-2}$ | $7.0 \times 10^{-2}$ | >200 |
| Example 6 | $1.3 \times 10^{-4}$ | $8.4 \times 10^{-2}$ | $4.2 \times 10^{-1}$ | >200 |
| Example 7 | $9.0 \times 10^{-5}$ | $1.1 \times 10^{-1}$ | >1 | >200 |
| Example 8 | $8.9 \times 10^{-5}$ | $3.3 \times 10^{-1}$ | >1 | 200 |
| Example 9 | $6.3 \times 10^{-4}$ | $4.9 \times 10^{-2}$ | >1 | >200 |
| Example 10 | $5.1 \times 10^{-4}$ | $1.3 \times 10^{-1}$ | $4.0 \times 10^{-1}$ | >200 |
| Example 11 | $3.6 \times 10^{-4}$ | $9.0 \times 10^{-3}$ | >1 | >200 |
| Example 12 | $1.6 \times 10^{-4}$ | $3.6 \times 10^{-2}$ | $3.9 \times 10^{-2}$ | >200 |
| Example 13 | $1.8 \times 10^{-4}$ | $4.6 \times 10^{-2}$ | $5.1 \times 10^{-2}$ | >200 |
| Example 14 | $1.7 \times 10^{-4}$ | $3.1 \times 10^{-2}$ | $3.5 \times 10^{-2}$ | >200 |
| Example 15 | $1.7 \times 10^{-4}$ | $3.6 \times 10^{-2}$ | $3.4 \times 10^{-2}$ | >200 |
| Example 16 | $2.0 \times 10^{-4}$ | $4.9 \times 10^{-2}$ | $6.4 \times 10^{-2}$ | >200 |
| Example 17 | $1.3 \times 10^{-4}$ | $3.7 \times 10^{-2}$ | $4.0 \times 10^{-2}$ | 150 |
| Comparative Example 1 | $5.9 \times 10^{-3}$ | >1 | >1 | >200 |
| Comparative Example 2 | $2.1 \times 10^{-3}$ | >1 | >1 | >200 |
| Comparative Example 3 | $7.0 \times 10^{-5}$ | >1 | Melting observed | 125 |
| Comparative Example 4 | $6.4 \times 10^{-5}$ | Melting observed | Melting observed | — |

From Tables 1 and 2, it is evident that DPF having electrodes formed with the Al-Cr alloy film of the present invention, has excellent thermal shock resistance and oxidation resistance.

EXAMPLES 17 TO 30

DPF was prepared in the same manner as in Example 1 except that a blend powder comprising aluminum powder (purity: at least 99%, particle size: at most 125 μm), chromium powder (purity: at least 98%, particle size: at most 75 μm) and, as a third component, lanthanum hexaboride powder (purity: at least 98%, particle size: at most 106 μm), titanium powder (purity: at least 99%, particle size: at most 150 μm), manganese powder (purity: at least 99%, particle size: at most 75 μm) or nickel powder (purity: at least 99%, particle size: at most 75 μm), was plasma-sprayed on a honeycomb structure made of silicon carbide (resistivity: 2.8 Ω·cm). The physical properties of each Al-Cr alloy film are shown in Table 3, and the properties of each DPF are shown in Table 4.

TABLE 3

| | Al—Cr alloy film | | | | |
|---|---|---|---|---|---|
| | Al/Cr | Third component | | Oxygen | Film |
| | atomic ratio | Type | Content (wt %) | content (wt %) | thickness (μm) |
| Example 18 | 0.5 | $LaB_6$ | 20 | 5.4 | 50 |
| Example 19 | 0.5 | $LaB_6$ | 30 | 4.9 | 50 |
| Example 20 | 0.5 | $LaB_6$ | 36 | 4.7 | 50 |
| Example 21 | 0.5 | $LaB_6$ | 46 | 4.5 | 50 |
| Example 22 | 0.5 | $LaB_6$ | 50 | 4.5 | 50 |
| Example 23 | 1.9 | $LaB_6$ | 20 | 4.7 | 50 |
| Example 24 | 1.9 | $LaB_6$ | 30 | 4.3 | 50 |
| Example 25 | 1.9 | $LaB_6$ | 36 | 4.7 | 50 |
| Example 26 | 1.9 | $LaB_6$ | 46 | 4.2 | 50 |
| Example 27 | 1.9 | $LaB_6$ | 50 | 4.0 | 50 |
| Example 28 | 1.9 | Ti | 15 | 4.9 | 50 |
| Example 29 | 1.9 | Mn | 30 | 4.6 | 50 |
| Example 30 | 1.9 | Ni | 30 | 4.4 | 50 |

TABLE 4

| | Oxidation resistance: resistivity at room temperature of Al—Cr alloy film (2Ω · cm) | | | Thermal shock resistance: number of |
|---|---|---|---|---|
| | Before heat treatment | After heat treatment at 900° C. | After heat treatment at 1,000° C. | cycles at which peeling or cracking occurred |
| Example 18 | $3.4 \times 10^{-4}$ | $1.2 \times 10^{-2}$ | $3.0 \times 10^{-2}$ | >200 |
| Example 19 | $3.0 \times 10^{-4}$ | $6.8 \times 10^{-3}$ | $3.4 \times 10^{-2}$ | >200 |
| Example 20 | $2.2 \times 10^{-3}$ | $2.3 \times 10^{-2}$ | $3.8 \times 10^{-2}$ | >200 |
| Example 21 | $3.7 \times 10^{-3}$ | $5.5 \times 10^{-2}$ | $1.4 \times 10^{-1}$ | >200 |
| Example 22 | $6.1 \times 10^{-3}$ | $9.2 \times 10^{-2}$ | >1 | >200 |
| Example 23 | $1.5 \times 10^{-4}$ | $1.7 \times 10^{-2}$ | $2.3 \times 10^{-2}$ | >200 |
| Example 24 | $1.6 \times 10^{-5}$ | $1.5 \times 10^{-2}$ | $1.9 \times 10^{-2}$ | >200 |
| Example 25 | $1.6 \times 10^{-5}$ | $1.8 \times 10^{-2}$ | $2.9 \times 10^{-2}$ | >200 |
| Example 26 | $3.9 \times 10^{-4}$ | $4.9 \times 10^{-2}$ | $6.8 \times 10^{-2}$ | >200 |
| Example 27 | $4.4 \times 10^{-4}$ | $7.3 \times 10^{-2}$ | $9.4 \times 10^{-2}$ | >200 |
| Example 28 | $1.3 \times 10^{-4}$ | $4.6 \times 10^{-2}$ | $6.0 \times 10^{-2}$ | >200 |
| Example 29 | $3.6 \times 10^{-4}$ | $4.7 \times 10^{-2}$ | $5.3 \times 10^{-2}$ | >200 |
| Example 30 | $1.7 \times 10^{-4}$ | $2.6 \times 10^{-2}$ | $3.8 \times 10^{-2}$ | >200 |

From Tables 3 and 4,it is evident that DPF having electrodes formed with the Al-Cr alloy film of the present invention which-further contains lanthanum hexaboride, titanium, manganese or nickel, as the third component, has further improved electrical conductivity.

According to the present invention, it is possible to provide an Al-Cr alloy which shows excellent electrical conductivity free from progress of surface oxidation even in an oxidizing atmosphere at a temperature of from 900 to 1,000° C. and which is excellent in thermal shock resistance without peeling from ceramics or cracking even when subjected to repeated heat history.

Accordingly, the Al-Cr alloy of the present invention can be used, for example, as an electrode or a circuit to be used in a high temperature oxidizing atmosphere. Further, a composite material comprising the Al-Cr alloy of the present invention and ceramics which are integrated to each other, is useful for various heaters, circuit substrates or DPF.

What is claimed is:

1. An aluminum-chromium alloy having an atomic ratio of aluminum to chromium of from 0.2 to 10.9, which further contains at most 50 wt % but excluding 0 wt % of lanthanum hexaboride.

2. The alloy according to claim 1, which further contains at most 50 wt % but excluding 0 wt % of at least one component selected from titanium, manganese and nickel.

3. The alloy according to claim 1, wherein the lanthanum hexaboride content is at most 46 wt %.

4. The alloy according to claim 1, wherein the lanthanum hexaboride content is at most 36 wt %.

5. The alloy according to claim 1, further comprising not more than 10 wt % of oxygen.

6. The alloy according to claim 1, wherein the lanthanum hexaboride is coated with the aluminum and chromium.

7. A method for producing an aluminum-chromium alloy, which comprises thermally spraying a blend powder or alloy powder comprising aluminum and chromium, in an atomic ratio of aluminum to chromium of from 0.2 to 10.9, and at most 50 wt % but excluding 0 wt % of lanthanum hexaboride, and forming the aluminum-chromium alloy according to claim 1.

8. The method according to claim 7 wherein the thermal spraying is one of plasma spraying, arc spraying and flame spraying.

* * * * *